United States Patent [19]

Spadafora et al.

[11] Patent Number: 4,986,475

[45] Date of Patent: Jan. 22, 1991

[54] METHOD AND APPARATUS FOR SPRAYING FLUIDS

[75] Inventors: Paul F. Spadafora, Lagrangeville, N.Y.; John M. Kaiser, Westwood; James R. Davis, Boonton, both of N.J.

[73] Assignee: Nabisco Brands, Inc., East Hanover, N.J.

[21] Appl. No.: 157,976

[22] Filed: Feb. 19, 1988

[51] Int. Cl.[5] ..... B05B 3/02; B05C 5/00

[52] U.S. Cl. ..... 239/218.5; 239/214; 239/215; 239/142; 222/240; 118/24

[58] Field of Search ..... 239/689, 672, 673, 675, 239/677, 214, 214.21, 215, 218.5, 214.15, 219, 221, 222.11, 220, 142; 222/413, 240, 241, 242; 118/24, 300; 426/289, 293, 302, 307

[56] References Cited

U.S. PATENT DOCUMENTS

| | | | |
|---|---|---|---|
| 941,070 | 11/1909 | Granlund | 118/24 |
| 1,164,579 | 12/1915 | Curtis | 239/672 |
| 1,524,636 | 1/1925 | Bausman | 118/24 |
| 1,587,263 | 6/1926 | Willners | 239/214.21 |
| 1,761,132 | 6/1930 | Lauhoff | 118/24 |
| 1,877,350 | 9/1932 | Meachem | 239/214.21 |
| 2,165,191 | 7/1939 | Kucher | 239/214.21 |
| 2,692,798 | 10/1954 | Hicks . | |
| 2,762,653 | 9/1956 | Sinclair . | |
| 2,856,870 | 10/1958 | Naylor . | |
| 3,057,273 | 10/1962 | Wilson . | |
| 3,057,730 | 10/1962 | Morck . | |
| 3,120,198 | 2/1964 | Reid . | |
| 3,158,486 | 11/1964 | Morck et al. | 99/86 |
| 3,165,859 | 1/1965 | Waldrum | 239/681 |
| 3,167,032 | 1/1965 | Rhodes | 107/4 |
| 3,346,190 | 10/1967 | Shepherd | 239/514 |
| 3,596,633 | 8/1971 | Porter | 118/24 |
| 3,632,356 | 1/1972 | Silverstein | 99/134 |
| 3,885,496 | 5/1975 | Breitweg et al. | 239/222.11 |
| 4,233,016 | 11/1980 | Chin et al. | 425/288 |
| 4,246,838 | 1/1981 | Pulver et al. | 99/516 |
| 4,283,012 | 8/1981 | Hanson | 239/118 |
| 4,294,408 | 10/1981 | Snyder et al. | 239/218.5 |
| 4,456,446 | 6/1984 | Konig | 425/102 |
| 4,513,915 | 4/1985 | Kohler et al. | 239/455 |
| 4,540,528 | 9/1985 | Haegeman | 239/219 |
| 4,585,173 | 4/1986 | Soule | 239/453 |
| 4,591,102 | 5/1986 | Clarke | 239/655 |
| 4,600,150 | 7/1986 | Zelasko | 239/126 |
| 4,743,456 | 5/1988 | Spadafora et al. | 239/222 |

FOREIGN PATENT DOCUMENTS

| | | | |
|---|---|---|---|
| 470774 | 1/1951 | Canada . | |
| 656599 | 1/1929 | France . | |
| 310689 | 6/1972 | U.S.S.R. . | |
| 700298 | 11/1953 | United Kingdom . | |
| 2108869 | 5/1983 | United Kingdom | 239/697 |

*Primary Examiner*—Andres Kashnikow
*Assistant Examiner*—Christopher G. Trainor

[57] ABSTRACT

A spray device is used to deliver a liquid, liquid containing a solid or a solid in a shaped flow onto a surface. The spray device can be used to deliver the material downwardly, laterally or upwardly in the form of droplets, a curtain or a mist. The spray device consists of a housing which uses a center shaft to deliver the material from the feed end to the discharge end. At the discharge end this center shaft has a flange which rotates with the center shaft. This flange is adjustable. Disposed over this center shaft flange is a flange fixedly attached to the nozzle housing. The material that is being delivered is shaped into the desired form in this flange region of the spray device. This spray device is non-clogging. In a preferred embodiment the surface that is being coated is the surface of an edible food product such as a cookie, biscuit, cracker or candy. The coating can be an oil, an oil containing dissolved or suspended flavorants, or a confection such as chocolate.

33 Claims, 5 Drawing Sheets

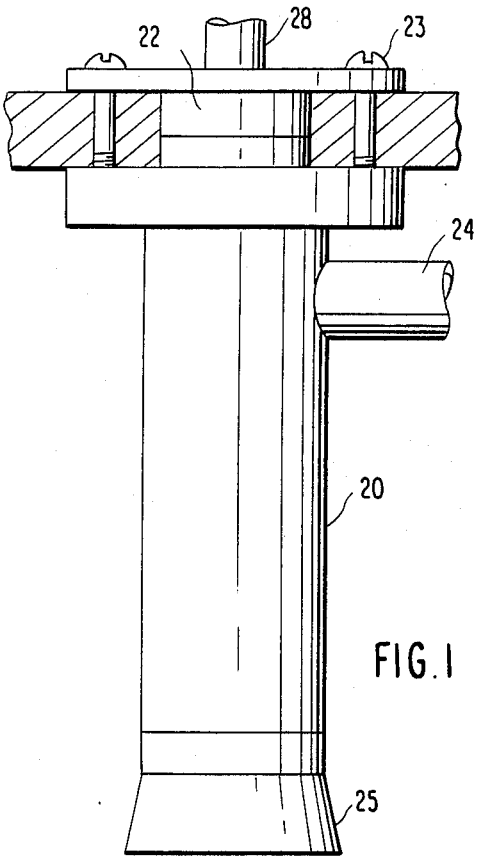
FIG. 1
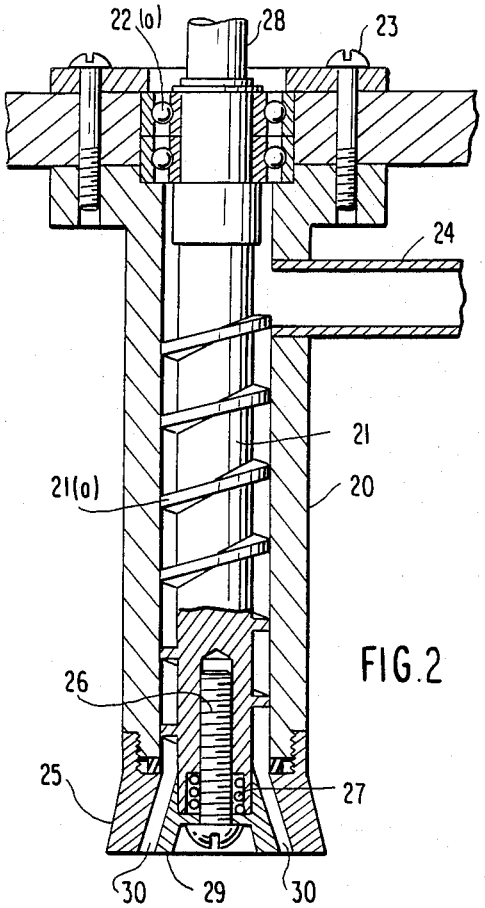
FIG. 2
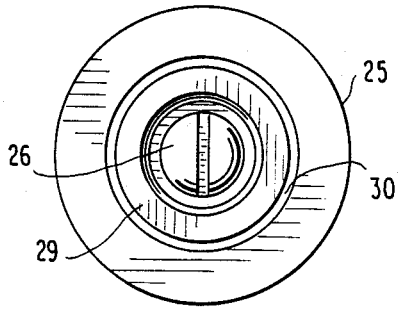
FIG. 3a
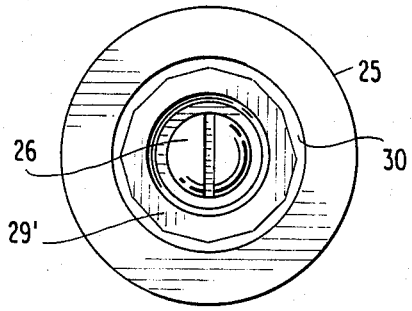
FIG. 3b
FIG. 3c
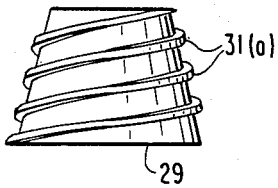
FIG. 3d
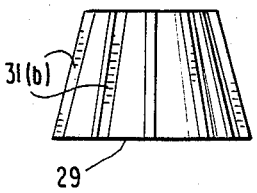

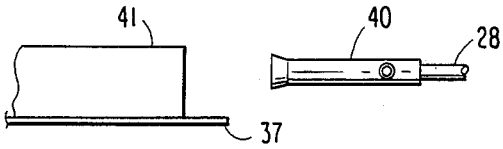
FIG. 6
FIG. 7
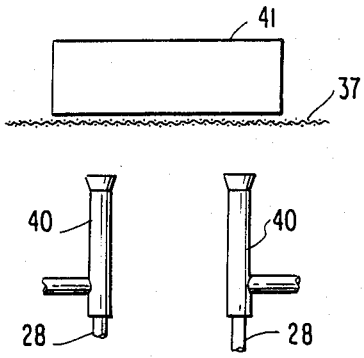
FIG. 8
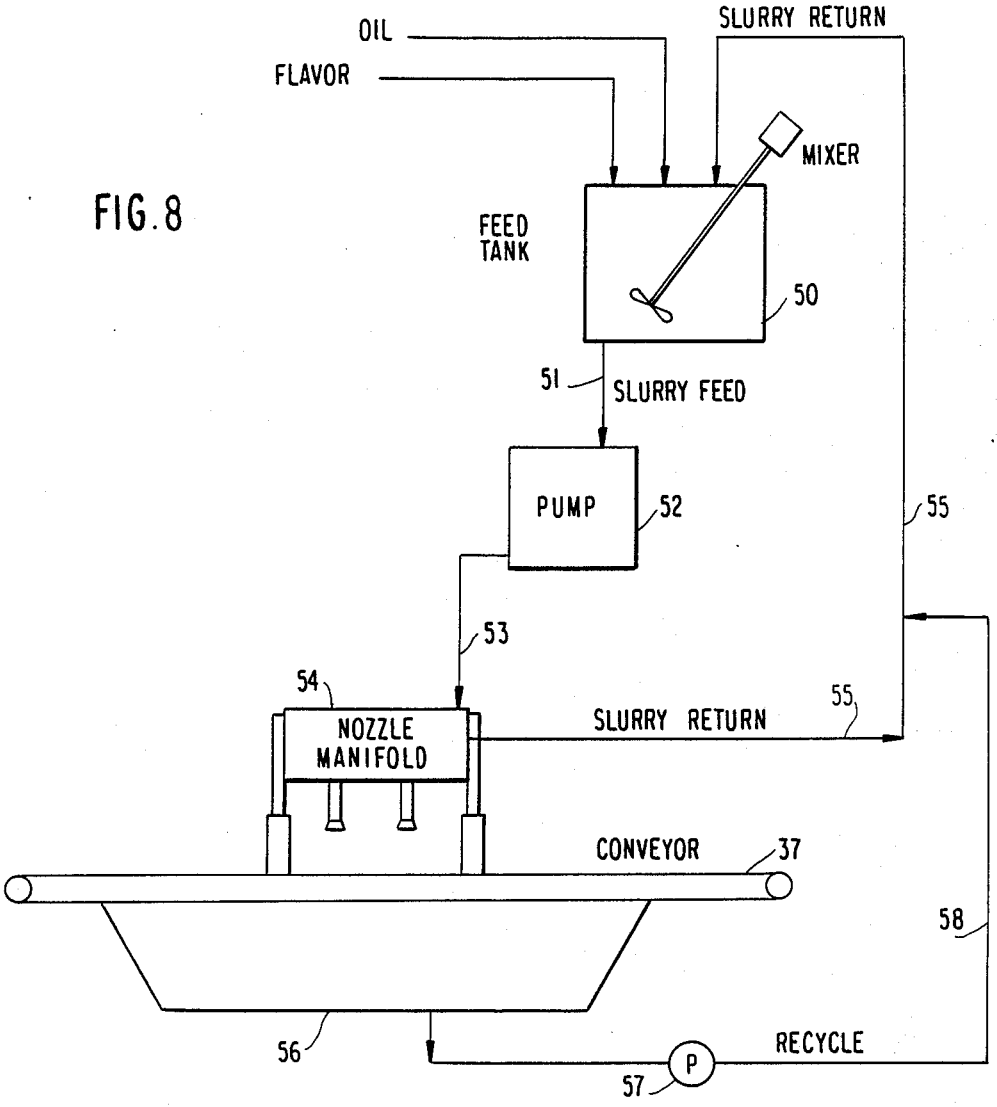

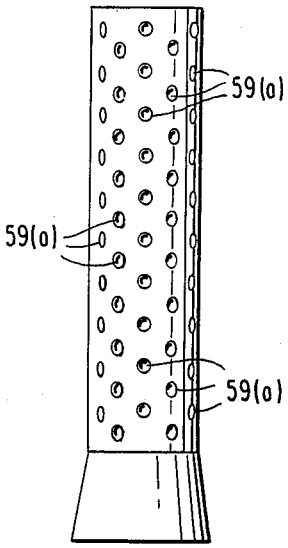
FIG. 9
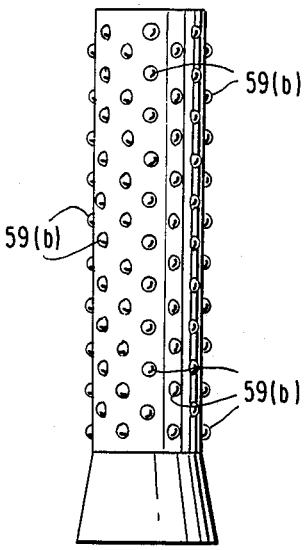
FIG. 10
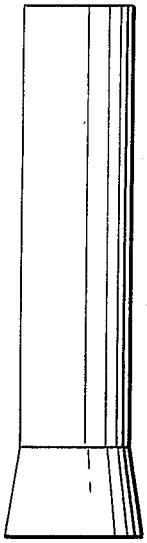
FIG. 11
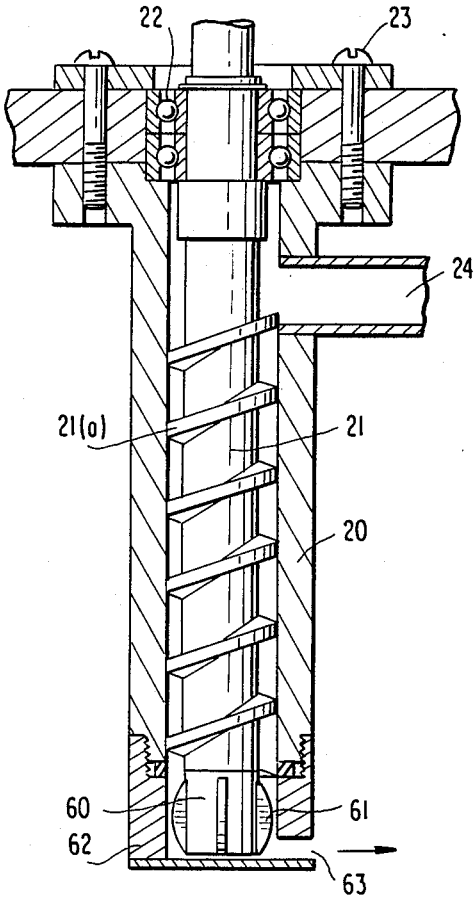
FIG. 12
FIG. 13
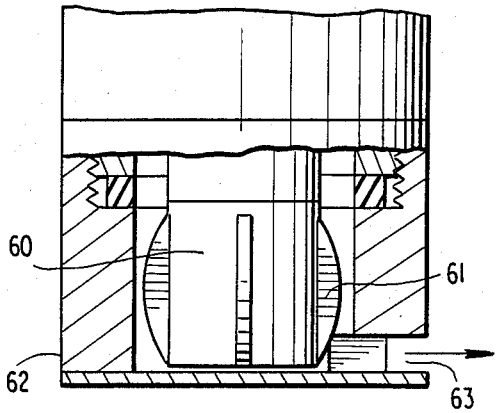

METHOD AND APPARATUS FOR SPRAYING FLUIDS

BACKGROUND OF THE INVENTION

This invention relates to a method and apparatus for spraying fluids such as liquids, particulate solids, and slurries. More particularly, this invention is directed to a method and apparatus for spraying a fluid onto a surface which is disposed above, below or laterally to the spray apparatus.

Spraying is a known technique for applying a liquid or a liquid containing a solid onto a surface. Spraying is a common technique used for applying paint and other protective coatings onto metal, wood and other surfaces. Cleaning agents and other like materials are also often applied by spraying onto a surface. In addition, in the food industry spraying is a common technique for applying coatings onto various products during the process of manufacture. It is therefore not surprising that in view of this widespread use of spraying for applying liquids, solids, and slurries onto surfaces that there are many types of equipment that are used to carry out the various spraying techniques.

Some spraying techniques use a pressurized gas such as air or carbon dioxide to propel the material being sprayed toward and onto a surface. In these techniques the pressurized gas will also serve to deagglomerate the material that is being sprayed. The technique known as airless spraying is also used to apply a material onto a surface. In these techniques the material to be applied is pressurized and ejected through a nozzle. The nozzle is usually a small opening through which the material being sprayed is forced. These are the most commonly used general techniques for spraying fluids onto a surface.

The present discovery is directed to a spray technique for applying substances onto a surface, and particularly the surface of a food item during the process of manufacture. Although the present device can be used to apply the sprayed material in the form of droplets or a discontinuous mist, it is particularly useful in the coating of food items wherein it is desired to coat the item using a continuous curtain of sprayed material. Such processes are also known as enrobing. In these processes a continuous curtain of the fluid is directed toward the material to be coated. The material to be coated will usually be moved across the path of the curtain, thereby becoming coated with the sprayed material. However, it is also possible to keep the material being coated stationary and to move the nozzle which is delivering the coating. In either embodiment a material can be coated with a curtain of a substance.

Since new food products are being constantly developed, new techniques must be developed in order to economically produce these products Many of these new products use various flavored coatings in order to produce different tastes. More products are being coated for this purpose. The coatings which are used range from liquids such as oils, liquids which have various dissolved substances such as flavorants, liquid-solid combinations in the form of slurries, and solids such as spices and flavorants. The ideal is to have spray equipment which can handle liquids, solids and liquid-solid mixtures. The present spray device can be used with these various materials. In addition, the present spray device can be used in essentially any orientation. That is, this spray device can apply a material downwardly, laterally or upwardly. In this way the top, sides and/or the bottom can be readily coated.

Various apparatus and methods have been used in the past to apply sprayed materials onto edible products. In U.S. Pat. No. 2,856,870 globules of fat are applied using a spray technique. The nozzles are directed downwardly for the ejection of the fat in divergent jets or sprays onto a dough sheet surface below. The fat is heated to maintain it at a liquid consistency. This would be a conventional spraying of a liquid onto a solid.

In U.S. Pat. No. 3,057,730 a plurality of spray batteries spray shortening and water onto a surface which also contains flour. By the successive deposits of shortening, water and flour there is constituted a batter which is subsequently baked into an edible product. The shortening and water that are sprayed downwardly onto the surface are sprayed in an atomized form. The shortening and water are atomized through the use of a gear pump.

U.S. Pat. No. 3,120,198 discloses the application of an oil onto biscuits and related food products. In this technique the oil that is to coat the dough is pumped to nozzles which coat the dough which is disposed below the nozzles. The nozzles are also moved in a reciprocating motion in order to get a uniform coating of the oil on the dough.

U.S. Pat. No. 3,158,486 discloses having one or more conventional spray units disposed over a food product for treating the food product with a liquid. After being treated with the sprays of oil and water the product is then baked in an oven.

U.S. Pat. No. 3,167,032 discloses the use of a hopper device for providing a coating onto a food product which is disposed below the hopper. In this technique a solid within the hopper will be dropped downwardly onto the food product. This hopper can have the exit designed such that the solid is delivered only to certain parts of the food product which moves below the hopper. This hopper solely uses gravity to deliver the solids onto the food product.

U.S. Pat. No. 3,632,356 discloses an apparatus for coating articles with a viscous liquid in such a way the articles, but not the tops thereof. This device uses a curtain of the coating material to coat the object. The tops are free of any coating, or partially free of any coating, by providing an interruption in the curtain in alignment with the object as it moves through the curtain area. This patent describes a conventional curtain enrobing technique for coating.

U.S. Pat. No. 4,246,838 discloses an apparatus and method for slitting the upper surfaces of a plurality of dough pieces which are on a conveyor. Along with slitting there are spray nozzles which deliver a spray of a fluid into the area of the newly formed slit. This oil is delivered by means of a conventional spray technique.

U.S. Pat. No. 4,283,012 discloses a self-cleaning nozzle. This nozzle is specially adapted for spraying food ingredients. The nozzle which is disclosed can be used to form a curtain of sprayed material which is used to enrobe the object which is disposed below the spray nozzle. This spray nozzle consists of an inner opening through which the enrobing material is pumped and surrounded by an outer opening through which a current of air passes. The combination of the air and the pumped material creates a curtain of the material to be applied. As noted in this patent, nozzles of this type are very susceptible to clogging. There apparently is no way to keep them from clogging. This patent is directed to a technique for periodically cleaning out the nozzle while it is in use. However, each time the nozzle goes through a cycle of being cleaned, the curtain is interrupted. If, at the same time the from being passed under the spray nozzle, some of this product will not be properly coated.

U.S. Pat. No. 4,456,446 discloses a method for applying oil onto portions of a dough. In this patent there is disclosed a technique for providing a downward indentation in a piece of dough and for applying oil into this downward indentation. The device for applying the oil includes a means for providing the oil in an intermittent manner.

These patents disclose various techniques for applying a liquid or a solid to a surface. However, the nozzle that produces a curtain of a material is highly susceptible to clogging. As a result, the curtain has to be interrupted periodically so that a nozzle opening cleaning means can move into the nozzle area to clear the nozzle. While the various techniques disclosed in these various patents are effective in various coating operations, the present nozzle, and the means of applying fluids to a surface, have many advantages. One advantage is that it is non-clogging. Another is that, in use to form a curtain, an air source is not also required. Yet another advantage is that the present spray device can be used in any orientation. That is, it can deliver the coating material downwardly, laterally or upwardly. This provides for considerable versatility in the coating of a surface with a material. In addition, the spray devices are easily and readily interchangeable. This is important when there is to be a change in the product to be coated. The spray devices can be quickly changed to accommodate such production changes.

BRIEF SUMMARY OF THE INVENTION

The present discovery is directed to a new apparatus and method for depositing a material onto a surface. The apparatus that is used for depositing material onto a surface consists of one or more spray devices. Each spray device is comprised of a housing means, preferably a cylinder, which has a rotatable center shaft means disposed therein to agitate and to optionally move the material that is to be deposited from the feed end to the discharge end of the housing means. A means used to agitate and to move the material is preferably a rotating auger, also known as a screw conveyor. However, this means can have a smooth surface or have one or more projections or one or more indentations. In one embodiment the discharge end of the spray device consists of a center shaft flange which rotates with the center shaft and a housing flange which is fixedly attached to the housing means in which the center shaft rotates. In operation, the material to be deposited onto a surface is pumped, or gravity-fed, to the feed end of the spray device. The center shaft is rotated and assists in the delivery of this material through the housing and to the discharge end. At the discharge end the material is formed into the mode of application between the center shaft flange which rotates with the center shaft and the housing flange which is fixedly attached to the housing means and is thus stationary. The shaped material flows through the discharge area and exits through the slit opening.

Depending on the speed of rotation of the center shaft the material to be deposited can be produced in various forms. For instance, at a slow center shaft rotation speed the material usually will be deposited as droplets. As the center shaft speed is increased and the delivery of the material to be deposited increased, the material will be formed and shaped into a continuous curtain. At yet higher center shaft speeds, the material will be delivered as a mist. However, regardless of the form in which the material is delivered, this nozzle exit is clog-free. That is, it can be operated continuously without any concern that the nozzle exit will clog or that there will be any significant change in the shape of the delivered material onto the surface.

In a second embodiment, the lower end of the housing means has a flange that is closed on its bottom surface but has one or more openings on the side surface. In addition, the lower part of the rotatable center shaft will have means to assist in propelling the fluid to be sprayed outwardly through the one or more openings. This embodiment provides a technique for spraying the fluid in a lateral direction rather than a downward direction while maintaining the spray device in the same orientation.

The spray devices can be mounted in any orientation for delivering the material. They can deliver the material downwardly, laterally or upwardly. In addition, these spray devices can be mounted in an array so that essentially any width surface can be coated with a material.

Although in preferred usage this device is used for depositing a material onto an edible food product, it can also be used for applying many different coatings onto many varied surfaces.

BRIEF DESCRIPTION OF THE DRAWINGS

FIG. 1 is an elevational view of the present spray device.

FIG. 2 is a longitudinal sectional view of the spray device of FIG. 1.

FIG. 3A is a view of the lower portion of the spray device of FIG. 1 looking upwardly into the nozzle area.

FIG. 3B is an alternate embodiment of the lower part of the spray device as shown in FIG. 3A.

FIG. 3C is an alternate embodiment of the lower part of the spray device where the center shaft flange is shown having spiral ribbing on the surface.

FIG. 3D is an alternate embodiment of the lower part of the spray device where the center shaft flange is shown having axial ribs on the surface.

FIG. 6 is an elevational view of the spray device of FIG. 1 disposed laterally of the surface that is to be coated.

FIG. 7 is an elevational view of the nozzle spray device of FIG. 1 disposed so as to apply a coating material upwardly onto a surface that is to be coated.

FIG. 8 is a schematic design of a system to provide coating material to the spray devices.

FIG. 9 is an elevational view of a center shaft having indentations.

FIG. 10 is an elevational view of a center shaft having projections.

FIG. 11 is an elevational view of a center shaft having an essentially smooth surface.

FIG. 12 is an elevational view of the spray device of FIG. 1, with an impeller nozzle.

FIG. 13 is an elevational view of the impeller nozzle of the spray device of FIG. 12.

DETAILED DESCRIPTION OF THE INVENTION

Figure 4:
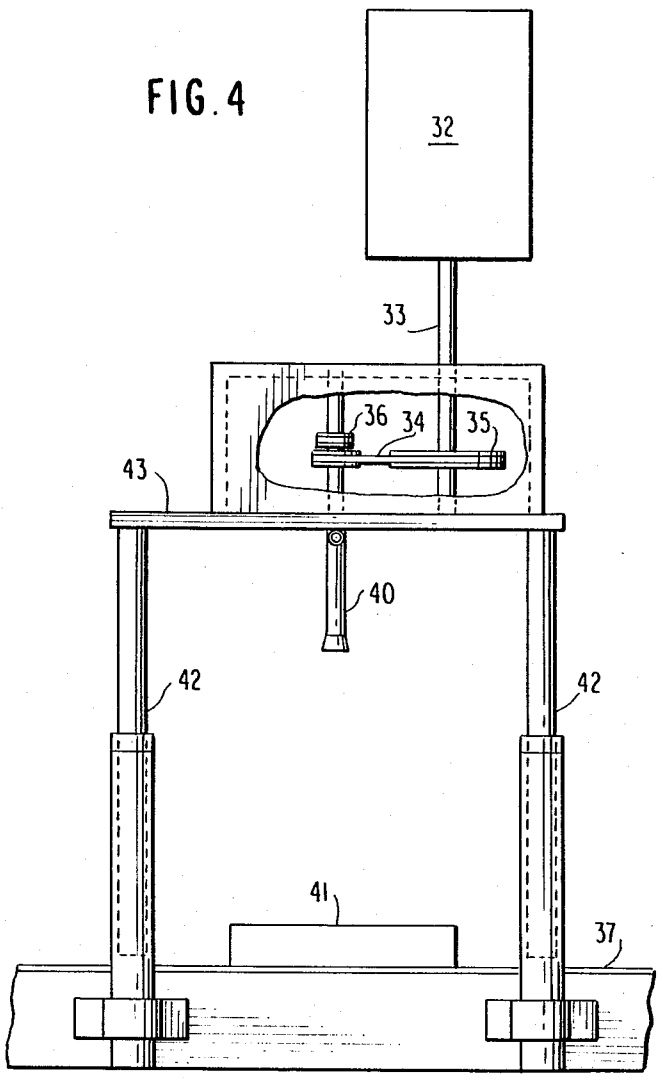
FIG. 4 is a side elevational view of an apparatus showing the use of two spray devices on a mounting means and disposed over a surface to be coated.

FIG. 1 shows a spray device in an elevational view. The spray device consists of housing 20 which has The housing is preferably cylindrical. On the upper end of housing 20 is conduit means 24 for flowing coating material into the housing. At the uppermost part of the housing 20 is a bearing-bushing 22 which seals drive shaft 28 into the housing 20. Screws 23 fasten the bearing seal onto housing 20.

FIG. 2 shows this spray device in a sectional elevational view. This view shows center shaft 21 disposed within housing 20 and adapted to rotate within housing 20. This center shaft is shown in the shape of an auger or screw conveyor with spiral ribbing 21(*a*). Drive shaft 28 provides rotational energy to the center shaft. Roller bearings 22(*a*) provide for the free rotation of the drive shaft. Center shaft 21 at its lower end carries flow shaping center shaft flange 29 which is adjustable by means of screw 26. Screw 26 is tensioned in position by means of spring 27. One or more washers can be used in place of the spring. Between housing flange 25 and center shaft flange 29 there is a space 30. This space 30 is the region where the material to be deposited at the nozzle exit flows outwardly. It is within this space 30 that the material gets shaped. Depending on the rotational speed of the center shaft, the material can be deposited as droplets, a curtain or as a mist. This space 30 will range from about 0.1 millimeters to about 10 millimeters or more.

The screw 26 is used to change the alignment of center shaft flange 29 within housing flange 25. Using this means of adjustment the flanges can be aligned so that their lower surfaces are in the same plane or the center shaft flange can be set to project below the housing flange or to be maintained within the housing flange. These adjustments will change the form of the nozzle output and/or the amount of output per unit of time. In essence, this provides a means for fine tuning the spray device.

FIG. 3A shows a cross-sectional view of the discharge end of the spray device of FIGS. 1 and 2. This is the material shaping section of the spray device. In this view there is illustrated an embodiment wherein the material will leave the nozzle in a circular pattern. FIG. 3B shows an embodiment where the housing flange 25 is circular in shape, but the center shaft flange 29′ has a multi-sided structure. This latter embodiment will provide for additional mixing in the shaping region and could be used where a high-solid content liquid is to be coated onto a surface. The housing flange and the center shaft flange can be of many various designs. The exact design chosen will depend on the objective that is desired to be obtained. In addition, either the center shaft flange or the housing flange can have one or more projections into the space 30 between the flanges. For instance, the center shaft flange could carry spiral ribs 31(*a*) as is shown in FIG. 3C which would tend to increase the flow of coating material to this exit end of the nozzle. In another embodiment, the center shaft flange could have a series of linear ribs 31(*b*) which would be axial or offset from the axis of the center shaft flange as is shown in FIG. 3D. These ribs can be of any size or shape. These views in FIGS. 3A, 3B, 3C and 3D are meant to be illustrative of the variations that can be used in the cylinder flange and center shaft flange for is not restricted to the construction of these flanges.

FIG. 4 shows spray devices 40 mounted in a manner to deposit a coating material downwardly onto a surface 41. This surface 41 is supported on conveyor 37 which moves this material past spray devices 40. Spray devices 40 are supported on support structure which consists of adjustable legs 42 and horizontal support 43. Motor 32 provides rotational energy to motor pulley 35 via drive shaft 33. Belts 34 convey this rotational energy to spray device pulleys 36. Spray device pulley 36 is mounted on the drive shaft 28 which is on the upper end of the center shaft of the spray device.

Figure 5:
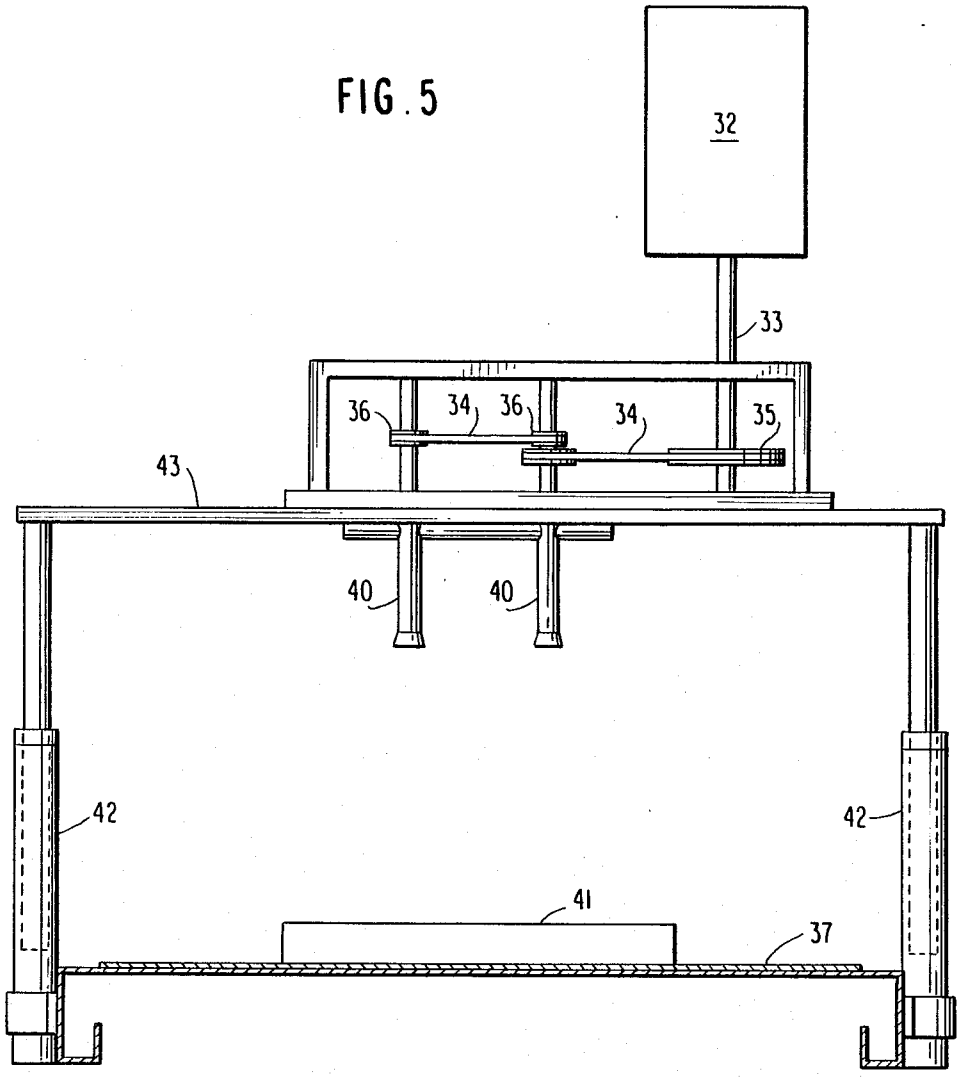
FIG. 5 is a front elevational view of the apparatus of FIG. 4 showing two spray devices on a mounting means and oriented over a surface that is to be coated.

FIG. 5 is a front elevational view of the arrangement of FIG. 4 showing the two spray devices in an arrangement for coating a surface 41 which is disposed below on conveyor belt 37. In this embodiment adjustable legs 42 support horizontal support 43. Each of the spray devices 40 is driven by motor 32. The rotational energy from this motor is conveyed from motor pulley 35 to spray device pulleys 36 by means of drive belts 34. Each spray device pulley is attached to and drives a center shaft. As shown here, each of these center shafts will be rotated at the same speed. However, this is not necessary. Either of the spray devices, via the belts and pulleys, can be adjusted to rotate at a different speed with the drive motor 32 driving both of the spray devices.

It is also contemplated that a direct drive system can be used. A direct drive system can consist of a separate motor to drive each center shaft or a single motor via gears driving two or more spray devices. Belt drive and direct drive systems each have advantages. Consequently, the exact choice will depend on the needs of a particular installation.

FIG. 6 is similar to the arrangement of FIG. 4 except that the spray device in this embodiment is mounted laterally on a vertical plate that would be supported by legs 42. In this embodiment the spray device 40 will coat one side of the surface 41 which is carried by conveyor belt 37. Although in this view it is shown that the spray device is on the right side of the surface to be coated, it could very easily be mounted so as to coat the surface on the left side. Also as a further possible embodiment, spray devices could be mounted as shown in FIG. 4 and FIG. 6 so that one or both side surfaces are coated as well as the top surface being coated. FIG. 7 shows spray devices 40 mounted beneath the surface to be coated. Spray devices 40 would be supported by a plate between legs 42. Conveyor 37 is of an open mesh type and carries the surface of the item to be coated. This is just one further orientation in which this spray device can be used. It is also possible that while a spray device is disposed beneath the surface to be coated that a spray device could be disposed along one or both sides, and further a spray device could be disposed over the material. Consequently, it would be possible to coat one surface, more than one surface, or all surfaces at any one time.

Although in FIGS. 4, 5 and 6 it is shown that the spray devices can be disposed above, laterally or under the material to be coated, it is also envisioned that the spray devices can be disposed at any angle. Due to the operation of the spray devices where the coating material is projected with a reasonable amount of force from the spray device, gravity does not play any significant role in the coating of the surface.

FIG. 8 shows a method for delivering a slurry feed material to the spray devices. In this diagram an oil containing a solid flavorant is fed to a feed tank 50 where they are mixed. This feed tank optionally has means to maintain it at a reduced or an elevated temperature. The feed slurry is drawn into the pump 52 via conduit 51 which then feeds this slurry through conduit 53 to one or more spray devices in spray device manifold 54. In this diagram it is shown that there are multiple spray devices which are fed from the spray device manifold. Although the spray devices can be fed through a series arrangement, it is preferred to use a parallel arrangement. The disadvantage of using a series arrangement is that the spray device that is located the greater distance from the feed conduit will experience a lower pressure than the other spray devices. It will therefore not have the same spray pattern as the other spray devices. However, although a parallel feed system, such as the use of a manifold to feed the spray devices, is preferred, in some uses a series arrangement would be likewise effective. The spray devices deliver the slurry downwardly to coat a material that is being carried beneath the spray devices on a conveyor belt 37. Excess feed slurry in the spray device manifold is continuously recycled to the feed tank via line 55. The reason for this recycle of the slurry feed is to redisperse any of the solid that may be settling out of the slurry and also to cool or heat the slurry as may be needed. If solely a liquid is to be the coating material, and this liquid is to be applied at room temperature, no recycle system would be needed. It is also possible in a further embodiment to have an excess collector tank 56 disposed below the conveyor belt 37 to contain the excess feed slurry that has been sprayed. This excess feed slurry would then be recycled to the feed tank through lines 58 and 55 by means of pump 57. In this type of an embodiment the conveyor belt would be a wire-type belt having openings that would permit excess feed slurry to fall downwardly into the collector tank.

FIG. 9 shows a center shaft of a spray device having a multiple number of indentations 59(*a*). These indentations can be of essentially any shape and size and serve to create a turbulent flow of the material being pumped through the housing. In this embodiment, the primary motive force propelling the coating fluid through the housing is the system pump. This is in contrast to the instance when the center shaft is an auger.

FIG. 10 shows a center shaft having projections 59(*b*). These projections can be of essentially any shape to create a mixed flow within the housing. This type of center shaft would have utility for spraying mixtures which tend to separate out very quickly. As in the center shaft design of FIG. 9, in this design the primary motive force propelling the coating fluid through the housing will be the system pump.

FIG. 11 shows a center shaft that has a smooth surface. This will produce a more laminar flow. Here, as in FIGS. 10 and 11, the primary motive force to propel the fluid through the housing will be the system pump.

FIG. 12 shows an embodiment of the spray device where the center shaft flange 60 carries an impeller arrangement 61. The impeller arrangement is preferred to be a separate piece from the rotatable center shaft. In this way the impellers can be changed for use with various items that are being sprayed. However, it is contemplated that the impeller can be an integral part of the rotatable center shaft. The housing flange 62 has an opening 63 on the side of the flange for the flow of coating material. This is in contrast to having the opening on the bottom of the flange. This housing flange can also be considered an extension of the housing. The opening 63 can encompass from about 5 percent to about 90 percent of the circumference of the flange. However, it will usually encompass about 50 percent of the circumference of the flange. This is equivalent to about a 180° arc. The height of the opening will range from about 0.05 centimeters to about 1.25 centimeters. The usual height will be about 0.10 centimeters to about 0.20 centimeters.

The impeller blades on the center shaft flange can be set off from the wall of the housing flange or be in a near scraping contact. When solids containing mixtures are to be sprayed, it is preferred that the impeller blades be in close contact with the wall of the housing flange.

FIG. 13 shows the impeller in more detail. Any impeller design can be used as long as the fluid to be sprayed is forced through the opening 63. This can be of a spiral or of a paddle wheel design. Also, these impellers can have indentations or projections.

Figure 14:
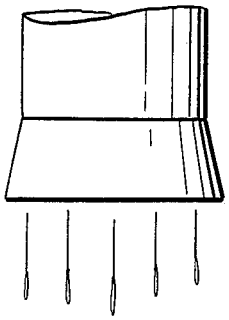
FIGS. 14 through 19 illustrate a type of flow from the spray device depending on the rotational speed of the center shaft section of the spray device.
Figure 15:
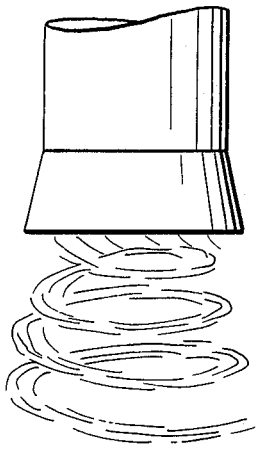
Figure 16:
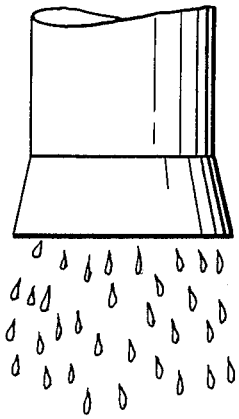
Figure 17:
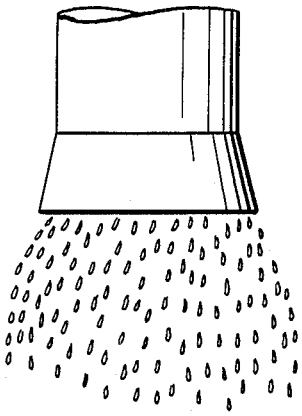
Figure 18:
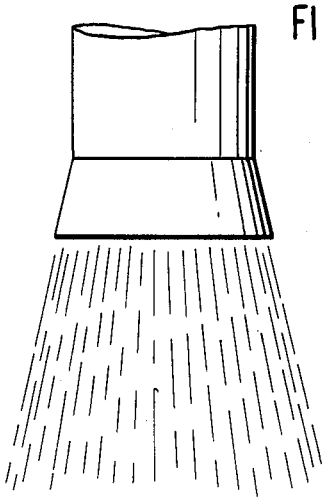
Figure 19:
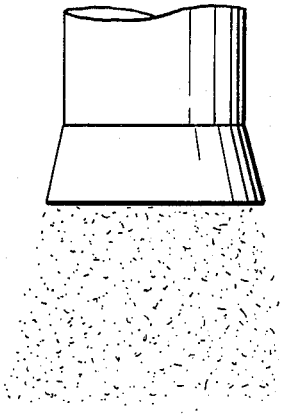

FIGS. 14 through 19 show the types of shaped flow that can be achieved from the spray device at various rotational speeds of the center shaft within the nozzle housing. At zero rotation as shown in FIG. 14, the coating material streams downwardly from the spray device. In FIG. 15, at a relatively slow center shaft speed, there results a dense spiral stream from the nozzle. As the revolutions per minute (rpm) are increased, the dense spiral stream converts to dense drops as is shown in FIG. 16. As the speed is further increased, the dense drops take on the parabolic trajectory of FIG. 17. As the rotational speed of the center shaft is increased into a range of about 2,000 rpm to 8,000 rpm, there results a directed flow curtain. This curtain, as shown in FIG. 18, is a continuum of the material. As the rotational speed is further increased, the curtain breaks down and FIG. 19 shows the material that is being sprayed as a mist. The speed of the center shaft will depend on the type of flow desired, the viscosity of the material and other factors. In general, as the speed of the center shaft is increased, the spray pattern is broadened.

The rotational speed that can be used with a spray device will depend to a considerable extent on the construction of the spray device and the type of output that is desired. Generally, a curtain-type of output is desired since this will provide a uniform coating onto a material disposed below the nozzle end. Since this is the case, the spray device will have to be of a design whereby a sufficient volume of coating material can be delivered to the flange area so that a curtain can be formed and maintained. The center shaft portion will deliver the coating material to the flange area where it will be shaped. Center shafts can be designed to deliver more or less material at the same rpm. The amount of material that is delivered would depend on the free volume within the cylinder and on the rotational speed of the center shaft. The free volume is the internal volume of the housing minus the volume occupied by the center shaft. In order to increase the free volume of the spray device, the diameter of the center shaft can be decreased while the depth of the spiral blade of the auger, or of any projections, is increased in the horizontal dimension. In the same manner, by reshaping the center shaft, lower volumes of coating material can be delivered to the nozzle shaping region. The type of spray device used will depend on the various factors. Included in these factors is the thickness of the coating that is desired. In addition, the speed of the conveyor carrying the material disposed below the spray device must be considered. A desirable center shaft rpm must also be considered. However, these are choices which are made by designers when they are constructing various manufacturing lines.

In use, goods such as crackers, biscuits, cookies, nuts, chips, candies or cereals travel on conveyor 37 beneath the spray devices 40. The spray devices are operated usually to provide a curtain of the coating material. A curtain is usually desired since this will result in a known and constant coating being applied. In operation, the coating material is pumped to the spray devices and the center shafts of the spray devices rotated at an increasing speed until a shaped curtain is produced. When a shaped curtain is produced, conveyor 37 is activated to move the goods 41 beneath the spray devices so as to be coated. Such a coating unit is operated continuously except for when it is scheduled for periodic maintenance. The spray devices 40 will not clog and thus there is no need to periodically stop the coating process to clean the nozzle ends and then restart the coating process. It is contemplated that this coating apparatus can be continuously operated for many days at a time. Actually, other units that would be associated with this coating unit would need attention before it would be required by the coating unit. During such intervals, while such other units are being adjusted or cleaned, this coating unit would undergo some maintenance. Other coating units do not have this versatility.

The fluid that is being sprayed ranges from water, water-sugar solutions, frostings, melted chocolate, oils such as peanut oil and vegetable oils, and water and oils containing spices and flavorants. The spices that can be sprayed include parsley, onion, celery salt, oregano, pepper, and garlic. The flavorants include cinnamon, lemon, orange, cherry, strawberry, raspberry, apple, pineapple, blueberry and the like. Further, granulated sugar, cooked meat solids such as bacon, cheese bits and similar substances can be applied using the nozzle. In addition, water/oil mixtures can be sprayed. There is essentially no limitation on the materials that can be sprayed using the present spray device.

EXAMPLE 1

An oil-based mixture was formed for spraying onto a food product carried on a conveyor below two overhead-mounted spray devices. The oil-based mixture consisted of 85 percent soybean oil, 5 percent vegetable protein and 10 percent solids spice mix. The oil-based mixture was kept under continuous agitation in the mixing tank.

The spray device has a ribbed center shaft flange. There are 12 ribs spaced at 30° intervals. Each rib is 0.125 inches thick and 0.125 inches in depth. The spray device was operated at between 7,000 revolutions per minute and 8,000 revolutions per minute and the oil mixture pumped to the spray device. At this spray device speed a curtain of the oil mixture is produced.

The speed of the conveyor carrying the items to be coated is 100 feet per minute. The conveyor is 2 feet wide. Spraying continued with no need to stop to clean the nozzle for the full test run.

What is claimed is:

1. A device for depositing a material onto a surface comprising:

(a) housing;

(b) means to introduce the material to be deposited into one end of said housing;

(c) rotatable means to assist in agitating said material to be deposited and moving said material to be deposited from one end of said housing to the other end of said housing;

(d) an opening in the sidewall on said other end of said housing adapted to direct the flow of material from said housing; and (e) means on the end of said rotatable means adjacent to the other end of said housing for assisting the flow of said material through the opening in the sidewall of said housing.

2. A system for depositing a material onto a surface comprising a plurality of spray devices disposed on a supporting means with effluent from said plurality of spray devices directed onto a defined area, each of said plurality of spray devices comprising:

(a) housing;

(b) means to introduce the material to be deposited into one end of said housing;

(c) rotatable means to assist in agitating said material to be deposited and in moving said material to be deposited from one end of said housing to the other end of said housing;

(d) an opening in the sidewall on said other end of said housing adapted to direct the flow of material from said housing; and (e) means on the end of said rotatable means adjacent to the other end of said housing for assisting the flow of said material through the opening in the sidewall of said housing.

3. A system for depositing a material onto a surface as in claim 2 wherein said surface is an edible food item.

4. A system for depositing a material onto a surface as in claim 3 wherein said edible food item is selected from the group consisting of biscuits, nuts, chips, crackers, cookies, candies and cereals.

5. A system for depositing a material onto a surface as in claim 2 wherein said rotatable means is rotated at about 1,000 revolutions per minute to about 15,000 revolutions per minute by said rotating means.

6. A system for depositing a material onto a surface as in claim 2 wherein said plurality of spray devices for depositing a material are disposed adjacent to said surface.

7. A system for depositing a material onto a surface as in claim 2 wherein said plurality of spray devices for depositing a material are disposed above said surface.

8. A system for depositing a material onto a surface as in claim 2 wherein at least one of said spray devices for depositing a material is disposed adjacent a side of said surface.

9. A system for depositing a material onto a surface as in claim 3 wherein said edible food item is selected from the group consisting of biscuits, nuts, chips, crackers, cookies and cereals.

10. A fluid application device for depositing material onto a surface of an article, comprising:

a housing having a fluid inlet and outlet;

a fluid agitator shaft rotatably disposed within said housing, said agitator shaft having a multi-sided end portion defined by a conical flow shaping shaft flange with an outer surface cooperating with a conical end portion of an inner surface of said housing located substantially at said outlet, wherein the outer surface of said end portion of said agitator shaft and the inner surface of said housing define a flow path having a substantially constant flow cross-sectional area to further prevent atomization of the fluid and wherein a downstream end of said conical flow shaping shaft flange is positioned substantially flush with an outlet end of said housing.

11. A device according to claim 10, wherein said fluid agitator shaft is a screw shaft for conveying and agitating the fluid through said housing.

12. A device according to claim 10, wherein said fluid agitator shaft includes a plurality of projections for agitating the fluid moving through said housing.

13. A device according to claim 10, wherein said fluid agitator shaft includes a plurality of indentations for agitating the fluid moving through said housing.

14. A fluid application device for depositing material onto a surface of an article, comprising:

a housing having a fluid inlet and outlet;

a fluid agitator shaft rotatably disposed within said housing;

a flow shaping shaft flange slidably connected to the downstream end of said agitator shaft; and an adjuster for varying the position of said flow shaping shaft flange relative to said agitator shaft, wherein said adjuster is configured so as to hold said flow shaping shaft flange in position relative to said agitator shaft during operation, wherein said adjuster is defined by a recess provided in the downstream end of said agitator shaft with an adjustable size spacer provided in said recess, and a fastener connecting said flow shaping shaft flange to said agitator shaft.

15. A device according to claim 14, wherein said flow shaping shaft flange is provided with a recess for slidably receiving an end portion of said agitator shaft.

16. A device according to claim 14, wherein said agitator shaft is a screw shaft.

17. A device according to claim 14, wherein said agitator shaft is provided with a plurality of indentations.

18. A device according to claim 14, wherein said agitator shaft is provided with a plurality of projections.

19. A device according to claim 14, wherein said agitator shaft is smooth surfaced.

20. A device according to claim 18, wherein said projections are defined by pimple-like protrusions extending from a substantially smooth outer surface of said agitator shaft.

21. A device according to claim 20, wherein said protrusions are disposed in substantially linear rows along the length of said agitator shaft.

22. A device according to claim 20, wherein a set of said protrusions are disposed around the periphery of said agitator shaft at a single location along the length of said agitator shaft.

23. A device according to claim 22, including another set of said protrusions disposed around the periphery of said agitator shaft at another location along the length of said agitator shaft, and wherein the location of said protrusions of one set are peripherally offset from the location of said protrusions of the other set.

24. A device according to claim 17, wherein said indentations are disposed in a plurality of rows along the length of said agitator shaft.

25. A device according to claim 17, wherein a set of said indentations are disposed around the periphery of said agitator shaft at a single location along the length of said agitator shaft.

26. A device according to claim 25, including another set of said indentations disposed around the periphery of said agitator shaft at another location along the length of said agitator shaft, and wherein the location of said indentations of one set are peripherally offset from the location of said protrusions of the other set.

27. A fluid application system for depositing material onto a surface of an article, comprising:

a fluid application device having a housing with a fluid inlet and outlet, and a fluid agitator screw shaft rotatably disposed within said housing wherein a flow path defined between said housing and said agitator shaft of said fluid application device is substantially constant cross-section and continuous and unidrectional at a downstream end portion of the device to prevent atomization of the fluid material, wherein said end portion of said screw shaft is defined by a multiple-sided conical flow shaping shaft flange which cooperates with a conical portion of the inner surface of said housing and is positioned substantially flush with an outlet end of said housing; and a fluid material supply fluidly connected to the inlet of said housing for supplying fluid at a pressure to provide a directed flow curtain exiting from the fluid application device onto the surface of the article.

28. A system according to claim 27, including a drive for rotating said agitator shaft at a speed to assist in providing the directed flow curtain.

29. A system according to claim 28, wherein said drive is capable of rotating said agitator shaft at about 1,000 to about 15,000 revolutions per minute.

30. A system according to claim 22, including a plurality of said fluid application devices disposed adjacent the surface of the article.

31. A system according to claim 30, wherein at least one fluid application device is positioned above the surface for depositing the fluid material downwardly onto the article.

32. A system according to claim 30, wherein at least one fluid application device is positioned on the side of the surface for depositing the fluid material sidewardly onto the article.

33. A system according to claim 30, wherein at least one fluid application device is positioned below the surface for depositing the fluid material upwardly onto the article.

* * * * *